US005551098A

United States Patent [19]

Wilk

[11] Patent Number: 5,551,098

[45] **Date of Patent: * Sep. 3, 1996**

[54] PERSONAL BIDET AND ASSOCIATED METHOD

[76] Inventor: Peter J. Wilk, 185 W. End Ave., New York, N.Y. 10023

[ * ] Notice: The term of this patent shall not extend beyond the expiration date of Pat. No. 5,361,427.

[21] Appl. No.: 337,556

[22] Filed: Nov. 10, 1994

Related U.S. Application Data

[63] Continuation-in-part of Ser. No. 181,666, Jan. 14, 1994, Pat. No. 5,361,427.

[51] Int. Cl.[6] ..... A47K 3/22; A47K 7/08

[52] U.S. Cl. ..... 4/420.300; 4/443; 4/445

[58] Field of Search ..... 4/420.3, 420.4, 4/443, 444, 445, 446, 447, 599, 602, 603, 604

[56] References Cited

U.S. PATENT DOCUMENTS

| | | | |
|---|---|---|---|
| 2,600,619 | 6/1952 | Conterno | 4/420.4 |
| 2,947,994 | 8/1960 | Saulson et al. | 4/445 |
| 3,039,117 | 6/1962 | Hoskins | 4/444 |
| 3,377,629 | 4/1968 | Di Pasquale | 4/445 |
| 3,416,529 | 12/1968 | Weisman | 4/443 |
| 3,577,567 | 5/1971 | Wintercorn | 4/445 |
| 3,916,453 | 11/1975 | Dominguez-Armada | 4/445 |
| 4,140,120 | 2/1979 | Yamauchi | 4/443 |
| 4,259,754 | 4/1981 | Bader et al. | 4/420.4 |
| 4,324,008 | 4/1982 | Carr | 4/420.3 |
| 4,326,308 | 4/1982 | Silver | 4/420.4 |
| 4,539,720 | 9/1985 | Westerweller | 4/602 |

FOREIGN PATENT DOCUMENTS

| | | | |
|---|---|---|---|
| 2425223 | 1/1980 | France | 4/602 |
| 478141 | 7/1928 | Germany | 4/443 |
| 329498 | 9/1929 | United Kingdom | 4/443 |
| 2133055 | 7/1984 | United Kingdom | 4/443 |

*Primary Examiner*—Henry J. Recla
*Assistant Examiner*—Charles R. Eloshway
*Attorney, Agent, or Firm*—McAulay Fischer Nissen Goldberg & Kiel, LLP

[57] ABSTRACT

A hygienic method utilizes a bidet device including a substantially annular frame having an inlet port, an outlet port and a reservoir chamber for guiding a fluidic cleaning agent from the inlet port to the outlet port. The method comprises the steps of (a) disposing the frame on a toilet bowl rim or toilet seat, (b) introducing the fluidic cleaning agent to the frame via the inlet port, (c) pressurizing the fluidic cleaning agent introduced to the frame, (d) dispensing the fluidic cleaning agent from the frame through the outlet port onto one's anus and/or external genitalia, and (e) subsequently to the step of dispensing, removing the bidet device from the toilet bowl rim or toilet seat.

9 Claims, 2 Drawing Sheets

PERSONAL BIDET AND ASSOCIATED METHOD

CROSS-REFERENCE TO A RELATED APPLICATION

This application is a continuation-in-part of application Ser. No. 08/181,666 filed Jan. 14, 1994, now U.S. Pat. No. 5,361,427.

BACKGROUND OF THE INVENTION

This invention relates to a bidet device. This invention also relates to an associated method for enhancing personal hygiene.

A bidet is a device for personal hygiene which is widely used throughout Europe. A user sits on or squats over a bowl and rinses his or her private parts with a jet of water which is dispensed vertically upwardly or in an upward arc from an outlet in the bowl. Generally, the European bidet is a device separate from a toilet.

A toilet attachment for producing a jet of water in the manner of a bidet has been introduced. This toilet attachment is substantially permanent and includes a toilet seat provided with water outlets. The bidet toilet seat is therefore used by anyone sitting on the toilet.

In addition to generally enhancing personal hygiene, the use of a bidet is recommended for treating several afflictions, including hemorrhoids and cystitis.

OBJECTS OF THE INVENTION

An object of the present invention is to provide a bidet device for use with a conventional toilet bowl.

Another, more particular, object of the present invention is to provide a personal bidet device removably attachable to a toilet.

A further object of the present invention is to provide a method for personal hygiene which involves use of a bidet device.

These and other objects of the present invention will be apparent from the drawings and detailed descriptions herein.

SUMMARY OF THE INVENTION

A bidet device comprises, in accordance with the present invention, a frame, at least one positioning element on the frame for temporarily maintaining the frame in a substantially fixed position on a toilet bowl or seat, an inlet port on the frame for receiving a fluidic cleaning agent, and an outlet port on the frame for dispensing the fluidic cleaning agent in an at least partially upward direction relative to the frame, the outlet port communicating with the inlet port. A feeder component is operatively connected to the frame for feeding a fluidic cleaning agent to the outlet port under pressure.

According to another feature of the present invention, the frame defines a reservoir. The inlet port and the outlet port communicate with the reservoir, while the feeder component is disposed on the frame for moving fluid from the reservoir and through the outlet port.

According to a further feature of the present invention, the feeder means includes a pump such as a vane pump or diaphragm pump. Alternatively or additionally, the feeder component includes a hose and a connector for temporarily attaching the hose at an input end to a household type faucet. In that case, a manually operable valve is provided for opening a path of communication from the input end of the hose through the inlet port and to the outlet port.

According to an additional feature of the present invention, the bidet device further comprises a floor member connected to the frame along one side thereof so as to define with the frame a shallow cavity. The outlet port may be connected to the frame via the floor member. Also, the floor member may be provided with at least one perforation for enabling a drainage of the fluidic cleaning agent from the cavity upon a flow of the fluidic cleaning agent into the cavity during use of the device.

According to yet another feature of the present invention, the positioning element includes a skirt connecting the floor member to the frame. The skirt and the floor member are insertable into the toilet bowl to fix the frame laterally with respect to the toilet bowl.

According to a further feature of the present invention, the inlet port includes an elongate hose enabling a filling of the frame with water from a household type faucet.

Furthermore, the outlet port may be one of a plurality of outlet ports all communicating with the frame member and particularly the reservoir thereof. The reservoir is annular and is disposed substantially concentrically about a first outlet port, while a second outlet port is disposed along a radially inner wall of the frame so that a stream of the fluidic cleaning agent from the second outlet port has a radially inward vector component.

The outlet port(s) may include a spray nozzle for spraying the fluidic cleaning agent upon a bottom side of the person.

A hygienic method in accordance with the present invention utilizes a bidet device including a substantially annular frame having an inlet port, an outlet port and means for guiding a fluidic cleaning agent from the inlet port to the outlet port. The method comprises the steps of (a) disposing the frame on a toilet bowl rim or toilet seat, (b) introducing the fluidic cleaning agent to the frame via the inlet port, (c) pressurizing the fluidic cleaning agent introduced to the frame, (d) dispensing the fluidic cleaning agent from the frame through the outlet port onto one's anus and/or external genitalia, and (e) subsequently to the step of dispensing, removing the bidet device from the toilet bowl rim or toilet seat.

Where the frame of the bidet device defines a reservoir, the introduction of the cleaning agent to the frame includes the step of at least partially filling the reservoir.

Where the frame includes a collapsible balloon member defining the reservoir, the pressurizing of the cleaning agent includes the step of sitting on the balloon member.

In one embodiment of the method of the invention, the disposition of the bidet device on the toilet bowl rim or seat is implemented prior to the introduction of the cleaning agent to the frame. This particular embodiment contemplates, for example, that a hose or tube is used to connect the frame or reservoir to a household type faucet. In this case, the fluidic cleaning agent is tap water.

The pressurization of the cleaning agent may be hydrostatically implemented. In other words, the water pressure in the plumbing may be used as the pressure for forcing the cleaning agent (water) out through the outlet port. The frame may be provided with a dispensing component for injecting or supplying a liquid soap or other disinfectant/cleaner into the water from the faucet. To that end, the frame may be provided with an auxiliary reservoir for the soap, disinfectant, perfume, or other auxiliary agent.

According to another feature of the present invention, the pressurization of the fluidic cleaning agent is accomplished via the operation of a pump. The pump may be incorporated into the frame.

According to a further feature of the present invention, where the outlet port is provided with a nozzle, the step of dispensing includes the step of spraying the fluidic cleaning agent. Where the outlet port is one of a plurality of outlet ports communicating with and connected to the frame, the step of dispensing includes the step of ejecting the fluidic cleaning agent in a plurality of different directions.

Where the frame is provided along one side with a web, the frame and the web defining a shallow cavity, the method further comprises the step of draining the fluidic cleaning agent from the cavity upon commencement of the step of dispensing.

A bidet device in accordance with the present invention is inexpensive and easy to use. The bidet is personal: it can be easily mounted to toilet temporarily for private use and subsequently removed and stored, so that the toilet is available for conventional use. Unlike more permanent fixtures, there is no need for complicated connections and valves. Pressure is applied automatically to eject water when the user sits on the device.

DETAILED DESCRIPTION

Figure 4:
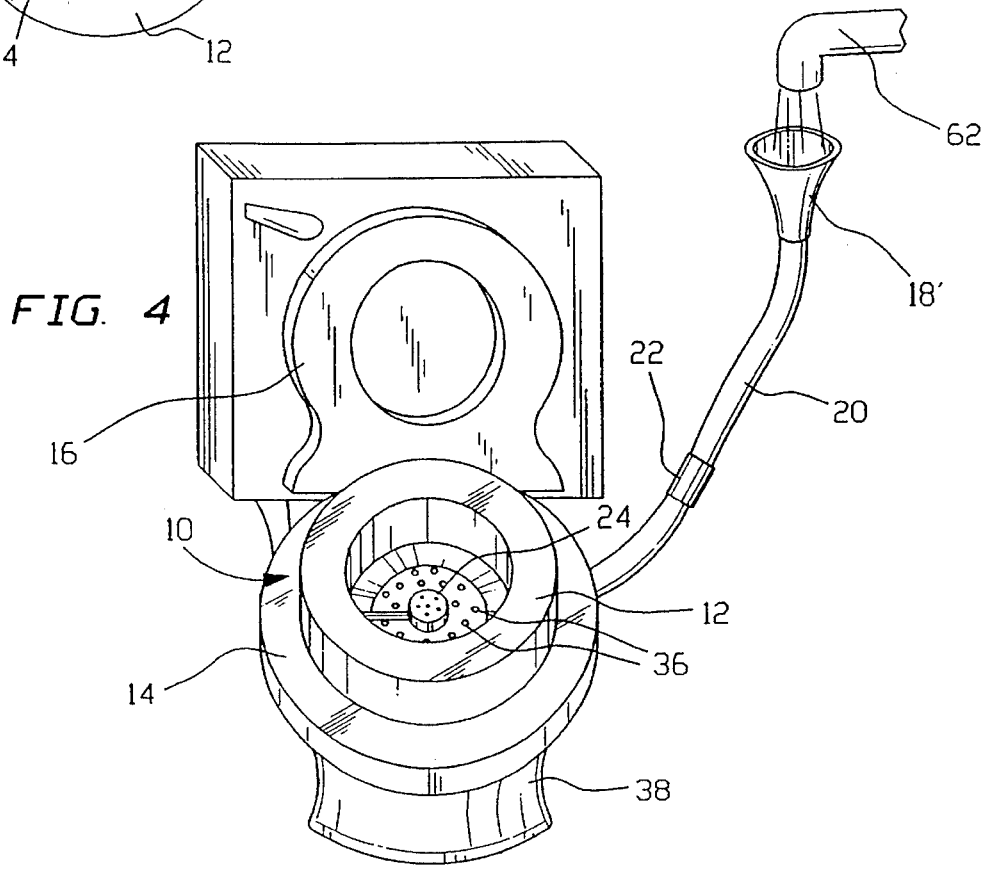
FIG. 4 is a perspective view of the personal bidet device of FIGS. 1–3, showing use of the device.

As illustrated in FIGS. 14, a bidet device 10 comprises a substantially annular balloon member 12 disposable on a toilet bowl rim 14 or toilet seat 16, as depicted in FIG. 4. Balloon 12 is provided with an inlet port 18 at the free end of a hose 20 for enabling a filling of balloon 12 with a fluidic cleaning agent such as water. A clamp or other valve element 22 is attached to hose 20 and thus operatively connected to balloon 12 for closing inlet port 18, i.e., for blocking communicating between the inlet port and balloon 12, upon a filling of balloon 12 with the fluidic cleaning agent. An outlet port 24 in the form of a spray nozzle communicates with balloon 12 via a connecting conduit 28 for dispensing the fluidic cleaning agent from balloon 12 when a user sits on balloon 12 and thereby applies compressive pressure to the balloon 12.

Bidet device 10 includes a floor member 30 in the form of a web or plate connected to balloon 12 via a skirt 32 along a lower side thereof so as to define with balloon 12 a shallow cavity or recess 34. Outlet port 24 is attached to floor member 30 generally centrally thereof.

Floor member 30 is optionally provided with one or more perforations 36 for enabling a drainage of the fluidic cleaning agent from cavity 34 upon a dispensing of the cleaning agent into the cavity during use of the device.

By virtue of skirt 32, floor member 30 is staggered with respect to balloon 12. Skirt 32 and floor member 30 are dimensioned so as to be insertable into a toilet bowl 38 while balloon 12 sits along rim 14 or seat 16. Balloon 12 is thereby fixed laterally with respect to toilet bowl 38 during use of the device 10.

Figure 1:
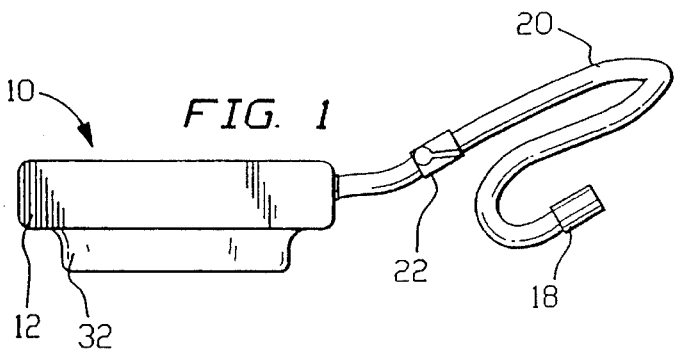
FIG. 1 is a side elevational view of a personal bidet device in accordance with the present invention.
Figure 2:
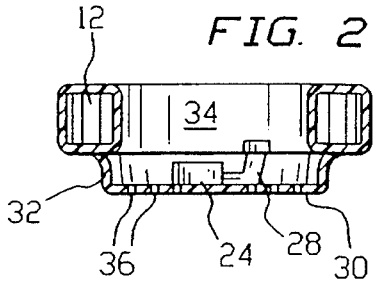
FIG. 2 is a cross-sectional view of the personal bidet device of FIG. 1.
Figure 3:
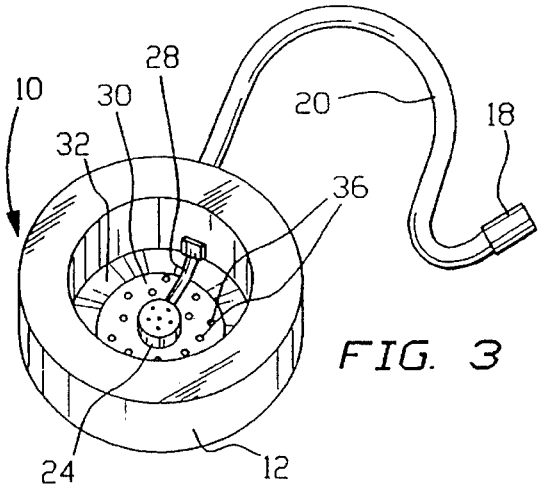
FIG. 3 is a perspective view of the personal bidet device of FIGS. 1 and 2.
Figure 5:
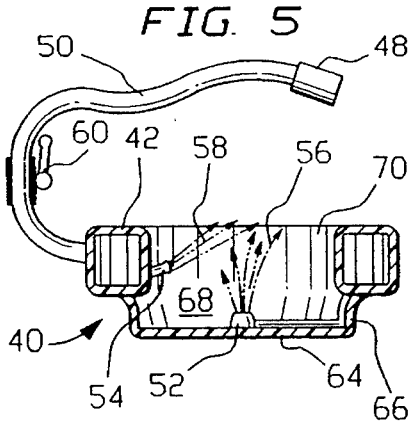
FIG. 5 is a cross-sectional view of a modified personal bidet device in accordance with the present invention.

As illustrated in FIG. 5, a personal bidet device 40 comprising an annular balloon member 42, provided with an inlet port 48 at the free end of a hose 50 for enabling a filling of balloon 42 with water, has a plurality of outlet ports or nozzles 52 and 54 for ejecting respective steams of water in at least partially upward directions, as indicated at 56 and 58. A clamp or other valve element 60 is attached to hose 50 for closing inlet port 48, i.e., for blocking communicating between the inlet port and balloon 42, upon a filling of balloon 42 with water from a faucet 62 (see FIG. 4). Outlet ports 52 and 54 dispense water from balloon 42 when a user sits on the balloon.

Bidet device 40 includes a floor member 64 in the form of a web or plate connected to balloon 42 via a skirt 66 along a lower side thereof so as to define with balloon 42 a cavity or recess 68. Outlet port 52 is attached to floor member 30 generally centrally thereof, while port 54 is attached along a radially inner wall 70 of balloon 42 so that the stream 58 of water from that port has a radially inward vector component, as well as an upward component.

In one method of utilizing bidet device 10 or 40, balloon 12 or 42 is disposed on toilet bowl rim 14 or toilet seat 16 so that skirt 32 or 66 extends downwardly into the toilet bowl 38. Hose 20 or 50 is extended to a faucet 62 (FIG. 4) so that water fed to inlet port 18 or modified inlet port 18' (FIG. 4) flows to and fills balloon 12 or 42. Upon at least a partial filling of balloon 12 or 42, valve 22 or 60 is closed to temporarily retain the water in balloon 12 or 42. Subsequently, the user sits on balloon 12, thereby pressurizing the balloon and dispensing water from the balloon through outlet port 24 (or 52 and 54 in FIG. 5) onto one's anus and/or external genitalia.

It is to be noted that valve 22 or 60 may take different, equivalent forms. For example, those valves may be sliding plate valves, or clamps with lever actuated camming elements (see FIG. 5), a devices for maintaining a kink in hose 20 or 50 upon formation of the kink by a user.

Figure 6:
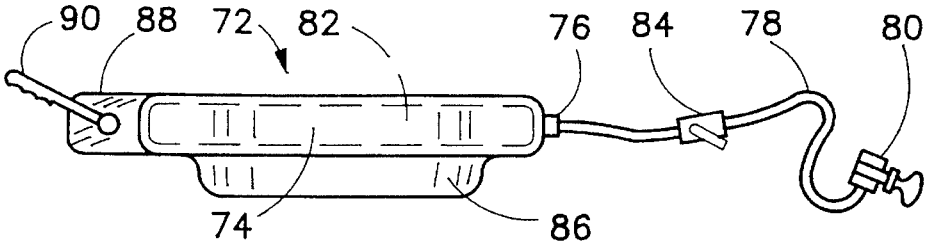
FIG. 6 is a side elevational view of another personal bidet device in accordance with the present invention.

A personal bidet device 72 illustrated in FIG. 6 has the same basic structure as device 10 of FIGS. 1–4, except that annular balloon member 12 (FIGS. 1–4) is replaced by a substantially rigid annular or toroidal frame 74. Frame 74 is disposable on a toilet bowl rim 14 or toilet seat 16, as described hereinabove with reference to FIG. 4. Frame 74 is provided with a primary inlet port 76 connected to one end of a hose or tube 78 which is provided at an opposite end with a secondary inlet port 80. Inlet port 80 serves as a connector for temporarily attaching hose 78 to a household type faucet (e.g., 62 in FIG. 4).

Frame 74 defines an annular reservoir 82 which is filled via tube hose 78 with a fluidic cleaning agent such as water. A clamp or other valve element 84 is attached to hose 78 and thus operatively connected to frame 74 for clamping hose 78 and thereby closing a flow path between inlet ports 80 and 76, particularly upon a filling of reservoir 82 with the fluidic cleaning agent.

Bidet device 72 of FIG. 6 has an outlet port (224) in the form of a spray nozzle communicating with reservoir 82 via a connecting conduit, as described above with reference to FIGS. 2–4. Bidet device 72 also includes a floor member identical to floor member 30 of FIGS. 2–4, the floor member being connected to frame 74 via a generally cylindrical or oval skirt 86. Skirt 86 is insertable into a toilet bowl 38 (FIG. 4) and thereby positions frame 74 with respect to the toilet bowl during use.

As further illustrated in FIG. 6, bidet device 72 is provided with a manually actuatable pump 88 which is attached to frame 74 and which communicates with reservoir 82 for pressurizing fluid therein to generate one or more streams of fluid from outlet port 224 and an outlet port 222 onto the anus and/or external genitalia of the user. Plump 88 includes a hand lever 90.

Upon a disposition of frame 74 on a toilet rim 14 or seat 16 (FIG. 4) and a connection of secondary inlet port 80 to a faucet, clamp or valve element 84 is opened to enable the filling of reservoir 82 with tap water. Upon the filling of the reservoir 82, clamp or valve element 84 is closed and lever 90 is turned to cause water to flow under pressure from the reservoir through the outlet port(s). After use, bidet device 72 is removed from the toilet rim 14 or seat 16 and stored until a subsequent use.

Figure 7:
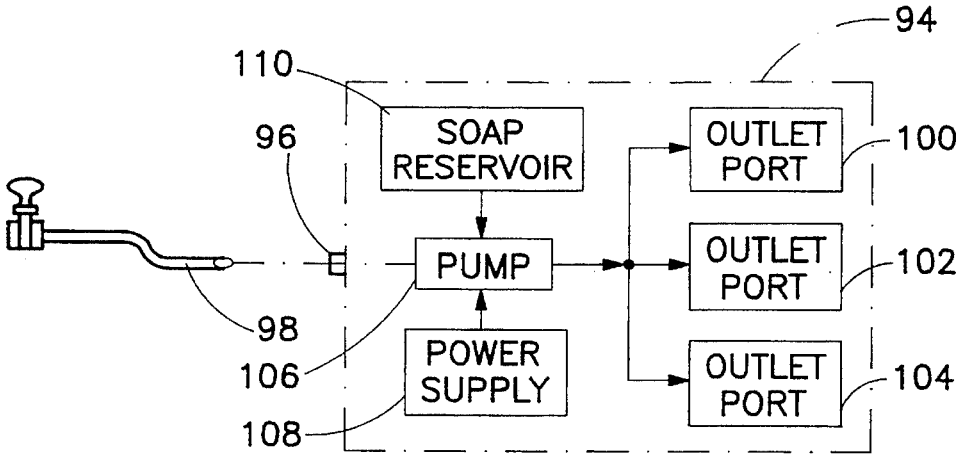
FIG. 7 is a block diagram of a further personal bidet device in accordance with the present invention.

As depicted in FIG. 7, a bidet device 92 comprises an annular frame, schematically represented at 94. The frame may be structurally identical to frame 74 of bidet device 72 (FIG. 6) and be provided with a positioning element in the form of a downwardly depending skirt (see skirt 86 in FIG. 6) for temporarily maintaining the frame in a substantially fixed position on a toilet bowl or seat. An inlet port 96 is provided on frame 94 for receiving tap water via a hose 98, while a plurality of outlet ports or spray nozzles 100, 102, 104 on frame 94 serve to dispense the water in an at least partially upward direction relative to the frame 94. A feeder component in the form of an electrically operable pump 106 is mounted in or on frame 94 for feeding water to outlet ports 100, 102, 104 under pressure. Pump 106 is energized with electrical power from a supply 108, which may include a battery or an electrical connection to an a–c voltage line. Pump 106 may take any suitable form, including, for example, a diaphragm pump or a vane pump.

Frame 94 may define a reservoir (not shown) as discussed above with respect to other embodiments. In that case, pump 106 moves water from the reservoir to the outlet ports 100, 102, 104 after the reservoir has been filled with water via hose 98. Alternatively, upon activation, pump. 106 may move water directly from hose 98 to outlet ports 100, 102, 104.

As further depicted in FIG. 7, a soap reservoir 110 is provided in or on frame 94 and is operatively connected to pump 106 for dispensing liquid soap into the fluid stream flowing from hose 98 and out through ports 100, 102, 104. Of course, other kinds of agents may be injected into the water stream, in accordance with the preferences of the user.

Figure 8:
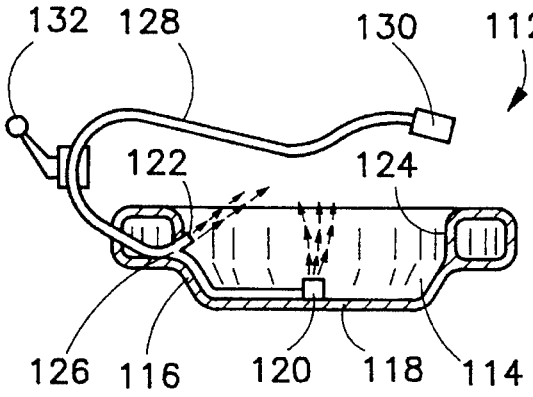
FIG. 8 is a cross-sectional view of yet another personal bidet device in accordance with the present invention.
Figure 9:
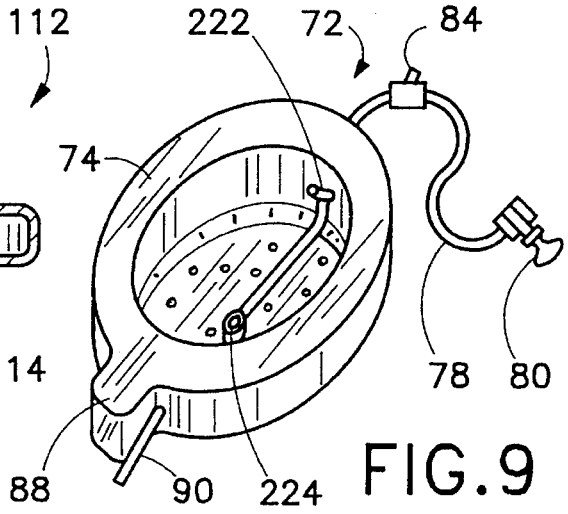
FIG. 9 is a cross-sectional view of the personal bidet device of FIG. 6.

In another bidet device 112 shown in FIG. 8, an annular frame 114 is provided with a downwardly depending skirt 116 which in turn secures a floor member 118. A first outlet port or spray nozzle 120 is attached to floor member 118, while a second outlet port or spray nozzle 122 is mounted in an inner cylindrical wall 124 of frame 114. A feeder element in the form of a bifurcated hose section 126 connects ports 120 and 122 to a hose 128. Hose 128 is provided at a free end with a connector 130 for temporarily attaching hose 128 in a fluid tight seal to a faucet (not shown). A clamp or valve element 132 on hose 128 serves to open a fluid path through the hose and to outlet ports 120 and 122. Upon a disposition of frame 114 on a toilet rim 14 or seat 16 (FIG. 4) and an attachment of connector or inlet port element 130 to a faucet, clamp or valve element 132 is opened to enable the flow of water directly to ports 120 and 122 via hose 128 and hose section 126. Upon the completion of a personal cleaning procedure, clamp or valve element 132 is closed. The tap valves (not shown) are closed and connector 130 is disconnected from the faucet. Thereafter, bidet device 112 is removed from the toilet rim 14 or seat 16 and stored until a subsequent use.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are profferred by way of example to facilitate comprehension of the invention and should not be construed to limit the scope thereof.

What is claimed is:

1. A hygienic method comprising the steps of:

providing a bidet device including a substantially annular frame having an inlet, an outlet and a reservoir chamber between said inlet and said outlet;

disposing said frame on a toilet bowl rim or toilet seat;

introducing the fluidic cleaning agent to said reservoir chamber via said inlet;

only after the introduction of the cleaning agent into said reservoir chamber, pressurizing the fluidic cleaning agent introduced to said reservoir chamber;

after pressurizing the fluidic cleaning agent in said reservoir chamber, dispensing said fluidic cleaning agent from said reservoir chamber through said outlet onto one's anus and/or external genitalia; and subsequently to said step of dispensing, removing said bidet device from the toilet bowl rim or toilet seat.

2. The method defined in claim 1 wherein said frame defines said reservoir chamber, said step of introducing including the step at least partially filling said reservoir chamber.

3. The method defined in claim 2 wherein said frame includes a collapsible balloon member defining said reservoir, said step of pressurizing including the step of sitting on said balloon member.

4. The method defined in claim 1 wherein said step of disposing is implemented prior to said step of introducing.

5. The method defined in claim 4 wherein said frame is provided with an elongate tube, said step of introducing including the steps of connecting said tube to a household type faucet and running water through said tube to said reservoir chamber.

6. The method defined in claim 1 wherein said step of pressurizing includes the step of generating hydrostatic pressure via a connection of said inlet means to a household type faucet.

7. The method defined in claim 1 wherein said outlet is provided with a nozzle, said step of dispensing including the step of spraying said fluidic cleaning agent from said nozzle.

8. The method defined in claim 1 wherein said outlet includes a plurality of outlet ports oriented in different directions, communicating with said reservoir chamber and connected to said frame, said step of dispensing including the step of ejecting said fluidic cleaning agent from said outlet ports in a plurality of different directions.

9. The method defined in claim 1 wherein said frame is provided along one side with a web, said frame and said web defining a shallow cavity, further comprising the step of draining said fluidic cleaning agent from said cavity upon commencement of said step of dispensing.

* * * * *